United States Patent [19]

Drössler

[11] 4,319,770

[45] Mar. 16, 1982

[54] SKI POLE

[75] Inventor: Peter Drössler, Isny, Fed. Rep. of Germany

[73] Assignee: DSI-Sportartikel GmbH, Weitnau, Fed. Rep. of Germany

[21] Appl. No.: 203,751

[22] Filed: Nov. 3, 1980

Related U.S. Application Data

[63] Continuation of Ser. No. 2,838, Jan. 11, 1979, abandoned.

[30] Foreign Application Priority Data

Feb. 23, 1978 [DE] Fed. Rep. of Germany ..... 2807800

[51] Int. Cl.[3] ..... A63C 11/24

[52] U.S. Cl. ..... 280/824

[58] Field of Search ..... 280/819, 827, 813, 824

[56] References Cited

U.S. PATENT DOCUMENTS

| | | | |
|---|---|---|---|
| 2,741,485 | 4/1956 | Storm et al. | 280/824 |
| 3,797,845 | 3/1974 | Kepka et al. | 280/824 |

FOREIGN PATENT DOCUMENTS

| | | | |
|---|---|---|---|
| 436072 | 11/1967 | Switzerland | 280/824 |
| 527678 | 10/1940 | United Kingdom | 280/819 |

*Primary Examiner*—David M. Mitchell

*Attorney, Agent, or Firm*—Edwin E. Greigg

[57] ABSTRACT

A ski pole comprising a tubular stem and a bracing disc especially shaped for easy mounting thereon. The bracing disc is provided with a stud introduced into the tubular stem and a pin is forced axially through and expanding the stud. The protruding portion of the pin may be enveloped by a sheath and constituting the tip of the ski pole.

3 Claims, 1 Drawing Figure

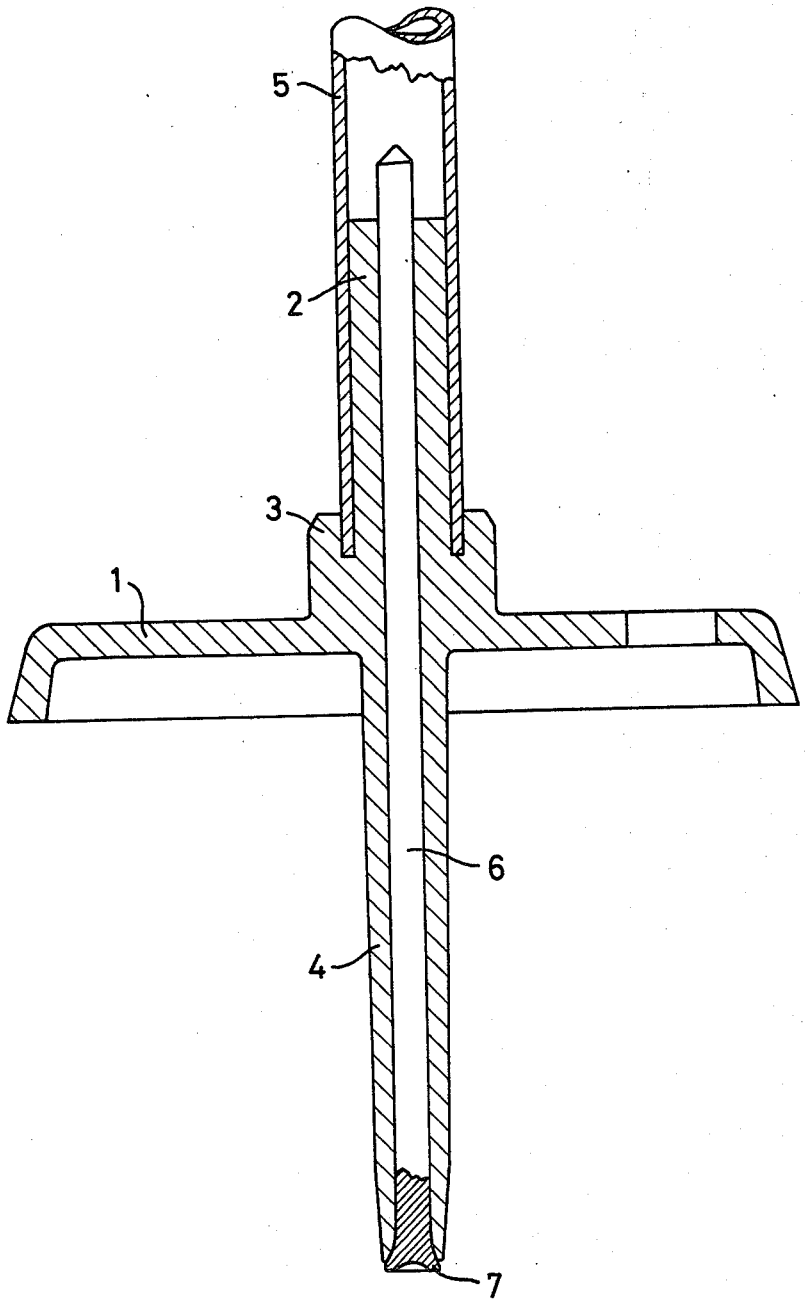
5
2
3
1
6
4
7

SKI POLE

This is a continuation of application Ser. No. 2,838, filed Jan. 11, 1979, and now abandoned.

CROSS REFERENCES TO PRIOR ART DISCLOSURES

There are no known prior patents anticipating the invention.

The present invention relates to a ski pole comprising a tubular stem and a bracing disc.

Known ski poles have their discs affixed to their stem at a certain distance from the bottom end of the latter. Thus the stem penetrates the disc. If the stem is a tube its bottom opening is plugged with an insert or a cap being the tip of the stem. Nowadays mostly tapered aluminum tubes are used for stems due to their pleasing, slender aspect. These known ski poles are expensive.

BRIEF SUMMARY AND FIELD OF THE INVENTION

It is an object of the present invention to produce a ski pole of high quality being manufactured rationally and thus being particularly cheap.

According to another object of the invention there is solved the problem of an improved ski pole means by securing the bracing disc to the end of a tubular stem by means of a stud introduced into the stem, a pin penetrating the stud and expanding same by means of the tip of the ski pole.

BRIEF DESCRIPTION OF THE DRAWING

The above and other objects and advantages of the invention will become apparent upon full consideration of the following detailed description and accompanying drawings in which:

The FIGURE is a cross-sectional view of an axial section of a lower end portion of a ski pole according to a preferred embodiment of the invention.

DETAILED DESCRIPTION OF THE PREFERRED EMBODIMENTS OF THE INVENTION

Referring now to the drawings there is shown an assembling of the ski pole to which there is introduced the hollow stud 2 into the tubular stem 5 and then driving a pin 6 into the stud thus expanding the stud 2 and pressing it against the interior of the tubular stem in safe keeping. The stud is preferably made in one piece with the bracing disc any may have several longitudinal slots, such facilitating the expansion. This way of assembling a ski pole is very simple. Moreover the invention provides means and teaching that make it possible to use normal cylindrical tubes as tubular stems.

The appearance of the proposed ski pole can be greatly improved by enveloping the portion of the pin located underneath the bracing disc with a tubular sheath. This sheath may be formed in one piece with the stud and the disc and may be tapered towards its free end. It is also proposed that the pin has a head 7 with an open cavity ground therein as known from other ski pole tips, the cavity having a sharp edge or crownlike serrations. A skillfully chosen proportion of the diameters of the sheath and the stem will give the impression of a stem tapered towards the tip, while in fact it is cylindrical and ends at the level of the bracing disc. This impression is strengthened by the fact that the disc has a collar enveloping the stem.

Referring now to the drawing an injection-molded bracing disc 1 of synthetic plastic material is provided on one side with a hollow stud 2 and a collar 3 and on the other side with a tubular sheath 4 tapered towards its free end. The entire plastic piece of the hollow disc 1 has a continuous axial bore throughout as shown. The hollow stud 2 is introduced into a tubular stem 5 preferably made of aluminum until the collar 3 caps the end of the tubular stem. To secure the plastic piece of the disc within the tubular stem 5, a pin 6 having a small head 7 with a cavity ground therein is the end of the sheath 4. The pin 6 is long enough to pass through the whole length of the hollow stud 2. The diameters of the pin 6 and the bore of the hollow stud 2 are chosen in order to expand the latter, to press it with great force against the interior surface of the tubular stem 5 and sheath 4 thus holding it together by friction.

The hollow stud 2 may have longitudinally disposed slots that are used to assist securing insertion of the pin and provide friction from it being withdrawn.

Additional embodiments of the invention in this specification will occur to others and therefore it is intended that the scope of the invention be limited only by the appended claims and not by the embodiment(s) described hereinabove. Accordingly, reference should be made to the following claims in determining the full scope of the invention.

What is claimed is:

1. A ski pole comprising a tubular stem having an inner wall, a bracing disc being secured to the tubular stem, a pin having a shank portion and a small head with a cavity ground therein forming a lower tip of the pole, a stud of tubular construction being integrally and concentrically formed on said bracing disc extending from one side of the disc into the end portion of said tubular stem, a tubular sheath integrally and concentrically formed on and extending from the other side of said bracing disc and having a considerably smaller outside diameter for receiving said pin than said tubular stud, said shank portion of said pin being driven longitudinally through said tubular sheath and through said tubular construction of said stud and expanding said stud into a tight frictional lock with said inner wall of said stem.

2. A ski pole as defined in claim 1, wherein said bracing disc is a flanged contoured element.

3. A ski pole as defined in claim 1, wherein said bracing disc has a collar 3 enveloping the end of the tubular stem.

* * * * *